US011047193B2

(12) United States Patent
Fairweather

(10) Patent No.: US 11,047,193 B2
(45) Date of Patent: Jun. 29, 2021

(54) WELL ABANDONMENT AND SLOT RECOVERY

(71) Applicant: ARDYNE HOLDINGS LIMITED, Aberdeen Aberdeenshire (GB)

(72) Inventor: Alan Fairweather, Aberdeenshire (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 0 days.

(21) Appl. No.: 16/609,395

(22) PCT Filed: May 3, 2018

(86) PCT No.: PCT/GB2018/051180

§ 371 (c)(1),
(2) Date: Oct. 29, 2019

(87) PCT Pub. No.: WO2018/203062

PCT Pub. Date: Nov. 8, 2018

(65) Prior Publication Data

US 2020/0072009 A1 Mar. 5, 2020

(30) Foreign Application Priority Data

May 4, 2017 (GB) ..... 1707131
May 4, 2017 (GB) ..... 1707135

(51) Int. Cl.
*E21B 29/00* (2006.01)
*E21B 31/00* (2006.01)
(Continued)

(52) U.S. Cl.
CPC ..... *E21B 29/00* (2013.01); *E21B 21/12* (2013.01); *E21B 29/005* (2013.01);
(Continued)

(58) Field of Classification Search
CPC ..... E21B 29/005; E21B 31/005; E21B 31/16
See application file for complete search history.

(56) References Cited

U.S. PATENT DOCUMENTS 4,045,768 A 8/1977 Klimek
4,236,580 A * 12/1980 Bodine ..... E21B 31/005 166/177.1

(Continued)

FOREIGN PATENT DOCUMENTS

WO 2011061506 A3 1/2012
WO 2015105427 A3 9/2015

(Continued)

OTHER PUBLICATIONS

International Search Report dated Aug. 29, 2018 for PCT/GB2018/051180.

(Continued)

*Primary Examiner* — Shane Bomar
(74) *Attorney, Agent, or Firm* — Law Office of Jesse D. Lambert, LLC

(57) ABSTRACT

A method and apparatus for single-trip casing cutting and pulling for well abandonment and slot recovery. Perforations (28) are made in the casing (12) at a maximum depth using a punch tool (18) and fluid circulated through the perforations to determine a return at surface. In the event of a return at surface being detected, the casing (12) is cut and pulled. When no return is detected, perforations are made at increasingly shallower depths until a return is detected and the casing (12) is then cut and pulled. This ensures the maximum length of casing (12) is cut and pulled on a single trip in the well bore (10).

16 Claims, 3 Drawing Sheets

Figures 1A, 1B, 1C, 1D, 1E, 1F:
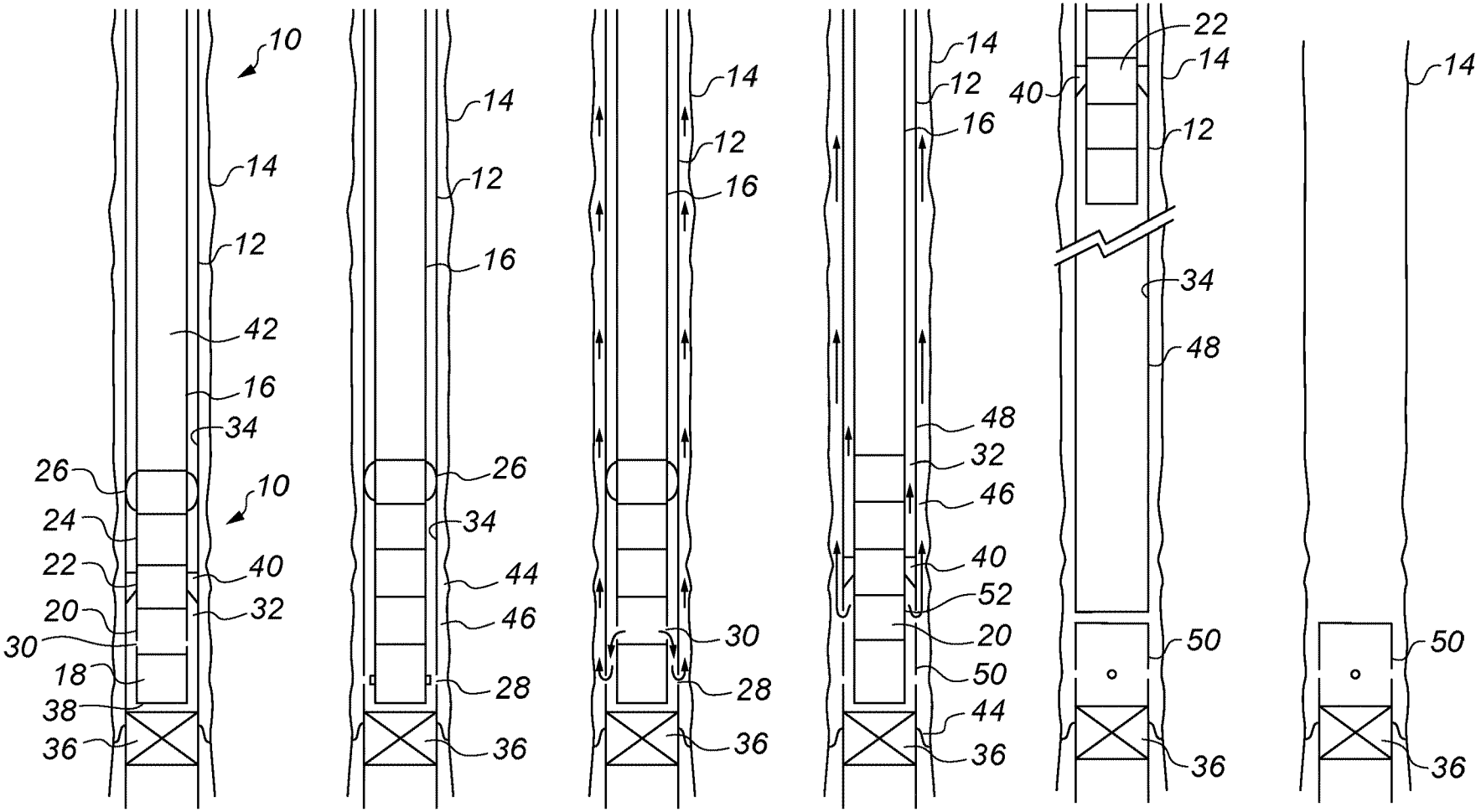

(51) Int. Cl.

| | |
|---|---|
| ***E21B 31/16*** | (2006.01) |
| ***E21B 33/12*** | (2006.01) |
| ***E21B 33/134*** | (2006.01) |
| ***E21B 47/10*** | (2012.01) |
| ***E21B 21/12*** | (2006.01) |

(52) U.S. Cl.

CPC ..... *E21B 31/005* (2013.01); *E21B 31/16* (2013.01); *E21B 33/12* (2013.01); *E21B 33/134* (2013.01); *E21B 47/10* (2013.01)

(56) References Cited

U.S. PATENT DOCUMENTS

| | | | | |
|---|---|---|---|---|
| 5,101,895 | A | 4/1992 | Gilbert | |
| 5,253,710 | A | 10/1993 | Carter et al. | |
| 5,957,225 | A * | 9/1999 | Sinor | E21B 7/061 175/171 |
| 6,431,270 | B1 * | 8/2002 | Angle | E21B 47/26 166/66.5 |
| 6,629,565 | B2 | 10/2003 | Harrell | |
| 9,045,958 | B2 | 6/2015 | Eddison | |
| 9,194,200 | B2 * | 11/2015 | Orstad | E21B 29/005 |
| 2002/0060076 | A1 | 5/2002 | Harrell | |
| 2009/0194277 | A1 * | 8/2009 | Burnett | E21B 43/112 166/255.1 |
| 2015/0047845 | A1 | 2/2015 | Larsen et al. | |
| 2015/0275605 | A1 | 10/2015 | Bennett et al. | |
| 2017/0016305 | A1 * | 1/2017 | Prieur | E21B 33/13 |
| 2019/0330949 | A1 * | 10/2019 | Kruger | E21B 29/005 |

FOREIGN PATENT DOCUMENTS

| | | | |
|---|---|---|---|
| WO | 2017015144 | A1 | 1/2017 |
| WO | 2017043977 | A1 | 3/2017 |

OTHER PUBLICATIONS

Freg et. al.; "Novel Approach to More Effective Plug and Abandonment Cementing Techniques"; Society of Petroleum Engineers; SPE Artic and Extreme Environments Conference & Exhibition; Moscow, Russia; Oct. 18-20, 2011.

International Search on Patentability dated Nov. 5, 2019 for PCT/GB2018/051180.

Schlumberger; Oilfield Review; vol. 24, No. 1; pp. 923-1730; Spring 2012; www.slb.com/oilfieldreview.

UK Search and Examination Report dated May 30, 2017 for GB17071317.

* cited by examiner

WELL ABANDONMENT AND SLOT RECOVERY

The present invention relates to methods and apparatus for well abandonment and slot recovery and in particular, though not exclusively, to a method and apparatus for casing recovery.

When a well has reached the end of its commercial life, the well is abandoned according to strict regulations in order to prevent fluids escaping from the well on a permanent basis. In meeting the regulations it has become good practise to create the cement plug over a predetermined length of the well and to remove the casing. Current techniques to achieve this may require multiple trips into the well, for example: to set a bridge plug to support cement; to create a cement plug in the casing; to cut the casing above the cement plug; and to pull the casing from the well. A further trip can then be made to cement across to the well bore wall. The cement or other suitable plugging material forms a permanent barrier to meet the legislative requirements.

Each trip into a well takes substantial time and consequently significant costs. Combined casing cutting and pulling tools have been developed so that the cutting and pulling can be achieved on a single trip.

In the ideal scenario, such tools would cut the casing at a maximum depth and then pull a section of the longest length possible from the well on a single trip. However, the presence of drilling fluid sediments, cement, sand or other debris behind the casing can prevent the casing from being pulled.

US2015047845 to Well Technology AS describes a method of removing casing from a well, in which an annulus between the outside of the casing and the inside of a surrounding downhole body is at least partially filled by a viscous and/or solid mass, the method comprising:

(A) setting a first sealing element into fluid-sealing engagement with the inside of the casing at a first depth in the well;

(B) lowering a string into the well, a cutting tool and a second, reversibly expandable sealing element being connected to the string, and the string being arranged to carry a fluid;

(C) forming perforations into the casing with said cutting tool at a second depth in the well which is smaller than the first depth at which the first sealing element is set into fluid-sealing engagement;

(D) expanding the second, expandable sealing element into fluid-sealing engagement with the inside of the casing a third depth in the well which is smaller than the second depth at which the perforations were formed, so that the perforations will be at a depth in the well between the first and second sealing elements;

(E) passing a fluid at high pressure through the string and into the annulus via the perforations so that the viscous and/or solid mass is displaced up the annulus, circulated out of the well and substantially replaced by the fluid, the fluid having a lower specific weight than the viscous and/or solid mass;

(F) cutting the casing around its entire circumference at a fourth depth, down to which the surrounding viscous and/or solid mass has substantially been replaced by the fluid; and (G) pulling a length of the casing up from the well.

This method advantageously washes out all material in the annulus between the outside of the casing and the inside of a surrounding downhole body, so that the casing is free to be cut and pulled without sticking. However, to ensure that all the viscous and/or solid mass is circulated up the annulus and out of the well, only short sections of casing can be washed, cut and pulled on each trip into the well. The process is thus started near the top of a section of casing, a short length of casing is perforated, washed and pulled, the casing being typically only a few metres in length. Additionally, the time taken to wash out the length of casing can be significant. The short length of casing is brought to surface and further trips are undertaken to perforate, wash, cut and pull subsequent lengths until the full length of the casing section is removed. The total time taken to remove the entire casing section is therefore very long.

A further disadvantage with this method is that the second sealing element, typically a packer, can only be set after the cutting tool has made the perforation. This is because the annulus between the string and casing must remain open in order to circulate fluid through the string and up the annulus to cool the cutting tool and carry swarf and other cutting debris to surface during operation of the cutting tool. Thus the packer, which is needed to direct the fluid for washing into the perforations, can only be set after the cutting tool has made the perforations. A major disadvantage of this is that the well is open during the cutting process and consequently there is no well control in the event a kick occurring.

In order to wash out greater lengths of casing, so that a longer length of casing can be pulled on a single trip, WO2015/105427 discloses a method for pulling out casing pipes or liner in a petroleum well, characterized by the combination of the following steps:

a) perforating an actual section of said casing pipe in said well by means of a perforating gun, said perforating gun mounted on a wash tool further arranged directly or indirectly to a drill pipe string;

b) by means of said wash tool arranged for isolating with gaskets on said tool's own stem isolating against said casing pipe's/liners inner wall above and below said wash tools outlet channel by said perforated section of said casing pipe and for flushing wash fluid out through said perforations, for thereby washing one or more annuli outside the perforated section for removing debris, particles or cement or other binding substance otherwise holding said casing pipe section, c) cutting, by means of a cutting tool the actual section of said casing pipe within or below the perforated section for releasing it from the remaining, deeper residing part of said casing pipe, d) pulling said released, washed-out section of said casing pipe out of said well.

The actual section of casing pipe is a length of casing which is longer than the perforation gun so that casing of lengths of 10 to 100 metres can be perforated along the entire length and circumference. Advantageously the distance between the gaskets on the wash tool is significantly smaller than the perforated casing length and thus wash fluid expelled out through the perforations will return to the annulus between the drill pipe and the casing at locations above the wash tool, to be circulated to surface. The wash fluid will carry debris back into the annulus for return also which is much more efficient than the washing process of US2015047845.

However, there are a number of disadvantages with this technique. The perforations must begin at the top of the length of casing that is to be removed, otherwise the debris in the annulus between the casing and the formation above the perforations may prevent the casing being removed. The location of the top perforations then becomes critical as sufficient length of unperforated casing to engage the casing spear is required. Engaging a spear on perforated casing may cause collapse of the casing as its integrity has been lost by perforation. Indeed, in well abandonment the casing may be old and corroded so that making multiple perforations weakens the casing and, when pulled, lower sections may break off. Yet further, lengths of perforated casing are more difficult to handle on surface. Like the earlier patent application, this technique also teaches to begin at the top of the casing section and move down the wellbore.

It is therefore an object of the present invention to provide a method of removing casing from a well which obviates or mitigates one or more disadvantages of the prior art.

According to a first aspect of the present invention there is provided a method of removing casing from a well, in which an annulus between the outside of the casing and the inside of a surrounding downhole body is at least partially filled by a viscous and/or solid mass, the method comprising:

(a) lowering a string into the well, a packer, a punch tool, and a cutting tool being connected to the string, and the string being arranged to carry a fluid;
(b) locating an end of the string in relation to a plug in the casing, the plug providing a seal across the bore of the casing at a first depth;
(c) forming one or more perforations through the casing with said punch tool at a second depth in the well, the second depth being shallower than the first depth;
(d) setting the packer at a third depth, the third depth being shallower than the second depth;
(e) pumping fluid through the string and through the one or more perforations;
(f) looking for a return at surface;
(g) in the event that a return is detected at surface, cutting the casing using the cutting tool to separate a length of cut casing from plugged casing; and
(h) pulling the length of cut casing from the well.

In looking for a return at surface a circulation test is performed. In this way, it can be determined if fluid has managed to pass through material in the annulus between the outside of the casing and the inside of the surrounding downhole body and if it has, there is a possibility that the casing can be pulled. In this way, the method can be used to pull longer lengths of casing than for the prior art, by starting at a lower depth and testing to see if the longest length can be cut and pulled.

If the circulation test is negative, and no return is detected at surface, the method includes repeating steps (c) to (h) at a shallower depth in the well. In this way, the steps are cycled until a positive circulation test is obtained. Thus the method will perforate and test at increasingly shallower depths until a first length of casing is cut and pulled. This advantageously speeds up the removal process as the steps of cutting and pulling do not occur until the longest length of casing that is likely to be free to pull is found. This is achieved on a single trip in the well.

Additionally, as washing through the perforations to circulate all the material to surface before a cut is made is not performed, the process is faster than the prior art by removing a separate washing step.

Preferably, upon pulling of a first casing section, steps (c) to (h) can be repeated at a greater depth to remove a second casing section. As the weight of material and casing will now be less, circulation may be achievable and further lengths of casing pulled.

Preferably, fluid is circulated through the cutting tool, the casing at the cut and up the annulus between the outside of the casing and the inside of the surrounding downhole body. In this way, material can be circulated out of the annulus between the outside of the casing and the inside of the surrounding downhole body during cutting and pulling of the length of cut casing. This can aid the cutting and pulling action.

By including a punch tool for making the perforations, step (d) can be performed before step (c) with the packer being set in advance of making the perforations as the punch tool can be operated without requiring circulation up the annulus between the string and the casing. In this way, well control is maintained during perforation. Additionally, the packer can advantageously be used to stabilise the punch tool in operation.

Preferably, tension is applied to the string to expand the packer. More preferably the tension is applied to operate the punch tool. In this way, the packer can be set in the same action as operating the punch tool.

Advantageously, there may be an anchor located on the string and the method includes the step of anchoring the string to the casing. In this way, the anchor can be used to pull tension against, assist in stabilising the punch tool, assist in stabilising the cutting tool and be used to grip and pull the cut casing to surface.

Optionally, the method includes an initial step of creating one or more upper perforations using the punch tool towards an upper end of the casing to be cut. Such upper perforations allow the migration of gas from the annulus between the casing and the downhole body. Advantageously, the upper perforations can be used as a return path to test for circulation when a wellhead seal assembly is in place. In such a case, the method may also include the step of pulling the wellhead seal assembly when the casing is pulled.

Optionally the method includes the step of creating one or more test perforations using the punch tool, such test perforations will be at a depth shallower than the third depth. Preferably the method then includes the step of performing a circulation test by circulating fluid between the perforations and the test perforations to detect circulation at surface. In this way, the method can include testing to identify a level of fill in the annulus between the casing and the surrounding downhole body.

Preferably, in step (g) the casing is cut by making a circumferential cut through the casing. In the preferred embodiment the cutting tool is a pipe cutter. Those skilled in the art will realise that other methods of casing cutting may be used such as jet cutting, laser cutting and chemical cutting.

Preferably, the string is a coiled tubing string. In this way, the cutting tool can be operated by rotation from surface. Alternatively, the string may be a drill string.

The surrounding downhole body may be the formation of the borehole. Optionally, the surrounding downhole body is a surrounding casing. The annulus is then the so-called B-annulus between the innermost casing and a surrounding casing.

The method may include setting the plug at the first depth to provide the seal across the bore of the casing. The method may include the step of setting the plug on the same trip as completing the other steps. In this way a further trip in the well is removed. Alternatively or additionally, the method may include pumping cement onto plug to provide the seal. In this way, the first depth will be at the top of the cement plug. The step of pumping cement may be completed on the same trip as setting the plug. In this way the number of trips is further reduced.

The method may include the step of dressing a cement plug. In this way, the seal may be a cement plug already located in the well.

According to a second aspect of the present invention there is provided apparatus for the removal of casing from a well, comprising a string for running inside the casing, the string including a punch tool, a cutting tool, a packer and a casing spear.

In this way, the steps of setting the packer, operating the punch tool, testing for circulation behind the casing, cutting the casing and pulling the casing can be achieved on a single trip into the well.

Preferably the casing spear comprises an anchor, the anchor being used to grip the inside surface of the casing. In this way, the string can be anchored to the casing and the cut casing can be pulled from the well.

Preferably the packer is a tension set packer. In this way, on setting the anchor below the packer, the packer can then be set by performing an overpull. The packer creates a two way seal in the annulus between the string and the inner wall of the casing.

Preferably, the punch tool is a tubing punch. In this way, single holes are punched from the casing without the use of explosives and without creating swarf and other cuttings. Circulation is also not required in the punch process.

Preferably, the cutting tool comprises a plurality of blades which are rotated to cut through the casing. In this way the cutting tool may be operated by rotating the string.

The apparatus may include one or more ports to allow fluid to pass radially out of the string as an alternative to exiting at the end of the string. Preferably, the ports are located on the punch tool. In this way, circulation can occur closest to the entry point through the casing to reduce the pressure drop for the return fluid path.

There may be a plug located at an end of the string. In this way, the seal at the first depth can be formed in the well on the same run as the punch, circulation test, cut and pull is achieved. The plug may be a bridge plug as is known in the art.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Figures 2A, 2B, 2C, 2D, 2E, 2F:
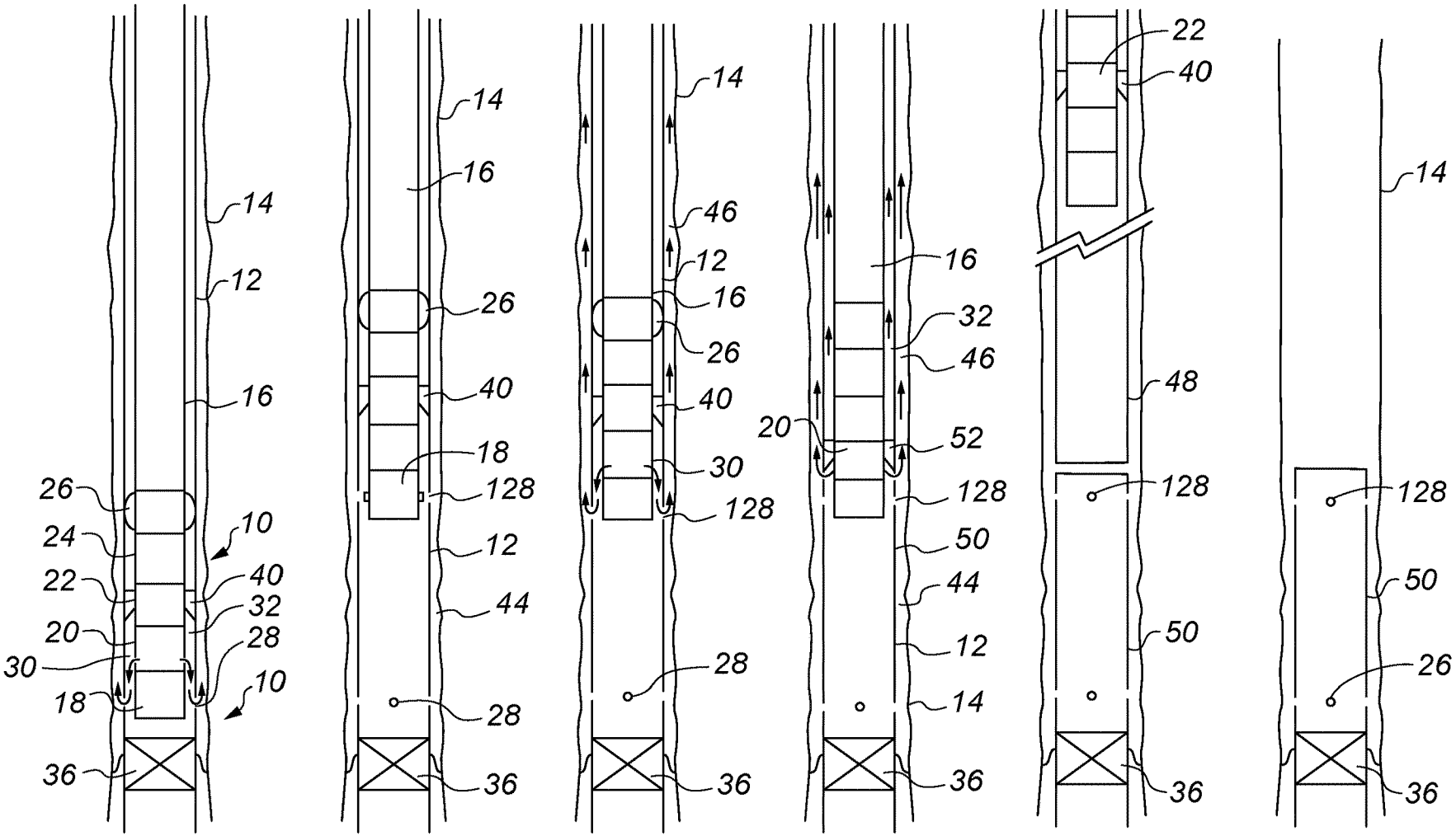
Figure 3:
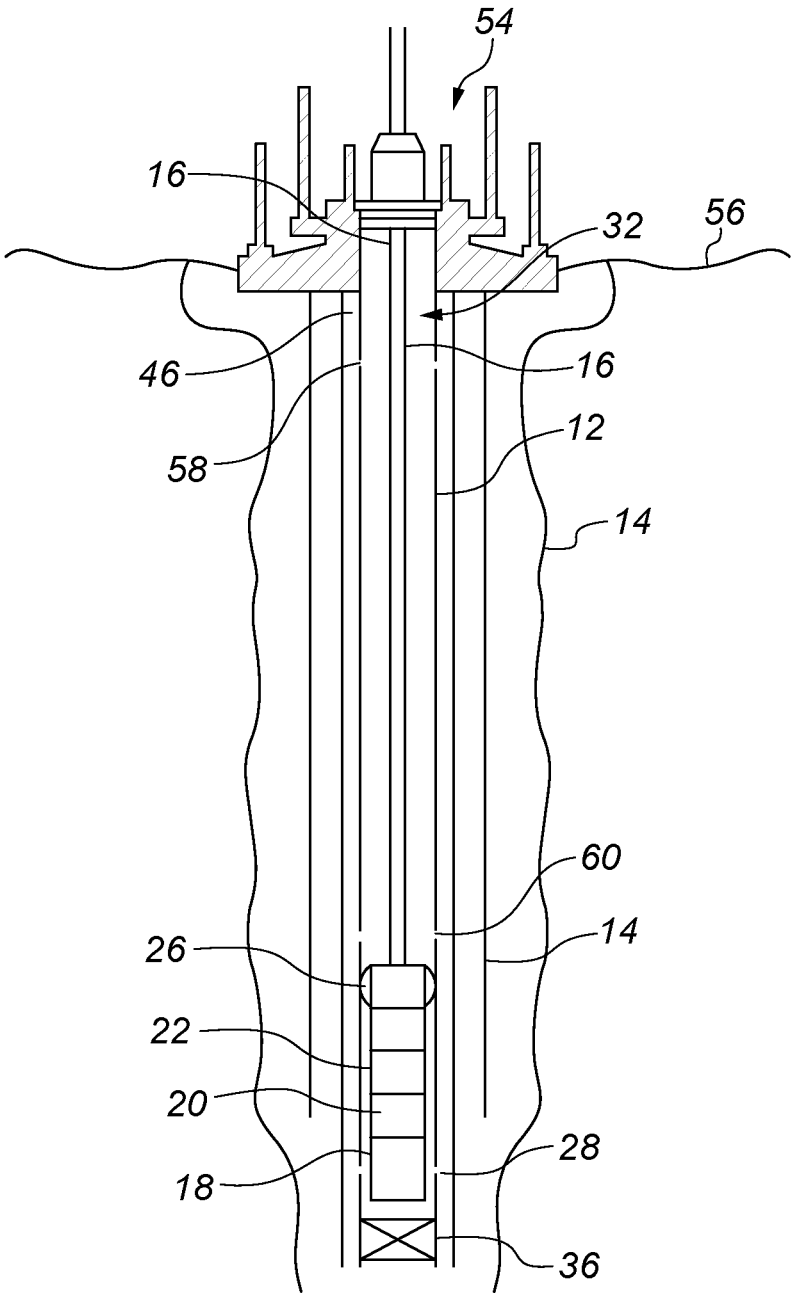

Embodiments of the present invention will now be described, by way of example only, with reference to the accompanying drawings of which:

FIGS. 1(*a*) to 1(*f*) illustrate a method, carried out on a single trip in a well bore, according to an embodiment of the present invention;

FIGS. 2(*a*) to 2(*f*) illustrate a method, carried out on a single trip in a well bore, according to a further embodiment of the present invention; and FIG. 3 is an illustration of a well in which punch hole positions in casing have been indicated.

Reference is initially made to FIG. 1 of the drawings which illustrates a method of removing casing from a well, carried out on a single trip, according to an embodiment of the present invention. In FIG. 1(*a*) there is shown a cased well bore, generally indicated by reference numeral 10, in which casing 12 lines the bore 14. A tool string 16 is run in the casing 12. Tool string 16 includes a punch tool 18, a cutting tool 20, a packer 26 and a casing spear 22.

The punch tool 18, cutting tool 20, packer 26 and casing spear 22 may be formed integrally on a single tool body or may be constructed separately and joined together by box and pin sections as is known in the art. Two or more parts may also be integrally formed and joined to any other part.

Tool string 16 may be a drill string or coiled tubing having a central bore for the passage of fluid pumped from surface, as is known in the art.

The punch tool 18 may be any tool which can create individual holes in casing. Preferably this is achieved without explosives and may be achieved by applying tension to the tool 18. The punch tool 18 may create a single hole. Alternatively the punch tool creates a plurality of holes spaced around a circumference of the inner wall 34 of the casing 12. The cutting tool 20 may be any tool which is capable of cutting casing downhole in a well bore. A pipe cutter, section mill, jet cutter, laser cutter and chemical cutter are a non-exhaustive list of possible cutting tools. The packer 26 is preferably a tension set packer wherein an elastomeric band is compressed to expand radially outwards and seal across the annulus 32 between the string 16 and the inner wall 34 of the casing 12. The casing spear 22 is an anchor 40 arranged as a slip designed to ride up a wedge and by virtue of wickers or teeth on its outer surface grip and anchor to the inner wall 34 of the casing 12. In a preferred embodiment the cutting tool 20, packer 26 and casing spear 22 are the TRIDENT system as provided by the present Applicants.

In FIG. 1 ports 30 are shown on the cutting tool 20. The ports 30 are arranged adjacent to the punch tool 18 so that fluid pumped down the string and ejected at high pressure from the ports has only a short distance to travel to exit the punched holes forming the perforations 28. Alternatively ports 30 can be arranged on a separate sub or may be combined with another tool. Where no ports are present, there will be a flow path through the string to the end thereof.

It will be recognised that other tools such as a bumper sub, logging tools, mills or drill bits may be incorporated on the tool string 16. Such tools are not illustrated on the figure merely to aid clarity.

In FIG. 1 there is shown a plug 36 located in the casing 12. Plug 16 creates a seal across the casing 12 and provides a sealed section to the casing 12 preventing the passage of fluids across the plug 16 in either direction. Plug 36 may be a cement plug present in the casing. The tool string 16 may include a drill bit (not shown) at a lower end 38 to dress the cement plug 36 when the string 16 is run into the casing 12. Alternatively, a bridge plug 36 may be provided at the lower end 38 of the string 16 and run-in on the string 16. The bridge plug 36 is then set as a first step in the method. If desired, cement can be pumped through the string 16 to land on the bridge plug 36 to create an additional cement plug. This can be done when a longer seal is required in the well bore 10. The plug 36 is set at a maximum depth in the cased well bore 10.

In the embodiment shown in FIG. 1, an anchor 40 is set on the casing spear 22. The anchor fixes the string 16 to the inner wall 34 of the casing 12. If desired, the string 16 can then be pulled to create sufficient tension to set the packer 26 located above the anchor 40. Preferably, the punch tool 18 is operated to punch one or more holes or perforations 28 around a circumference of and through the wall 34 of the casing 12. A single perforation 28 may be punched if desired.

Packer 26 is then expanded into sealing engagement with the inner wall 26 of the casing 12 at a location above the perforations 28, if this was not done before the punch tool 18 was operated. In a preferred embodiment the punch tool 18 and packer 26 are operated in a simultaneous action by applying tension to the string 16. Where the packer 26 is set before the punch tool 18, the packer 26 can be used to stabilize the punch tool 18 during the punching operation. With the packer 26 now set, a sealed section of the annulus 32 between the plug 36 and packer 26 is provided. This is illustrated in FIG. 1B.

Ports 30 are now opened to provide a circulation path for fluid from the throughbore 42 of the string 16, into the sealed section of annulus 32. Fluid pumped from surface at high pressure, will exit the string 16, enter the perforations 28 and try to find a path through the material 44 in the annulus 46 between the outer wall of the casing 12 and the inner wall of the bore 14. In FIG. 1C, a potential flow path is shown with the fluid returning up the annulus 46 to surface. This may be considered as a circulation test and the detection of a return at surface means that the test is positive.

On a positive circulation test, the cutting tool 20 is activated and the casing 12 is cut. The cut can be made in any way, for example by slicing, milling, grinding, melting, dissolving or ablation as long as it achieves independent upper 48 and lower 50 lengths of casing 12. This is illustrated in FIG. 1D. In the preferred embodiment cutting is achieved using blades and fluid is circulated out of the string 16 at the position of the blades to lubricate and cool the blades while providing further circulation up both annuli 32,46. In this way, cuttings can be returned to surface via the inner annulus 32 while material 44 can be encouraged to circulate to surface through the annulus 46. It will be noted that the packer 26 has been unset during cutting. This is done to provide the inner circulation path up annulus 32 and also to allow rotation of the string 16, if required, to operate the cutting tool 20. Cutting tool 20 could also be operated via a downhole motor.

With the casing cut, FIG. 1E, the anchor 40 is released and the tool string 16 is raised to a position for the casing spear 22 to grip the upper 48 length of casing 12. This is best achieved by setting the anchor 40 on the length 48 towards its upper end. Pulling the tool string 16 out of the well bore 10 recovers the upper 46 length of casing 12. The wellbore 10 is now left with a permanent barrier, in the form of the plug 36, in the lower length 50 of casing 12. This is illustrated in FIG. 1F. The upper 48 length of casing 12 has been recovered from the well bore 10.

All the steps shown in FIGS. 1A to 1E have been achieved on a single trip into the well bore 10 and a maximum length of casing 12 has been recovered.

Referring now to FIGS. 2A to 2F, there is illustrated further steps in the method which occur when the circulation test performed in FIG. 1C is negative. Like parts to those of FIGS. 1A to 1F, have been given the same reference numeral to aid clarity. FIG. 2A shows the step of circulating fluid through the ports 30 and into the perforations 28. However, there is no flow path available for the fluids to return to surface as the material 44 in the annulus 46 is solid or of a sufficient density to block fluid flow. In these circumstances it can be assumed that the casing 12 will be stuck in the bore 14 by the action of the material 44 therebetween. As the perforations are near the maximum depth, it is also unlikely that washing through the perforations 28 can create sufficient pressure to lift the material 44 and circulate it up the annulus 46 to surface. Thus on noting that a return is not recorded at surface and the circulation test is negative, the anchor 40 and/or packer 26 are released and the tool string 16 is pulled a distance out of the bore 14 to position the punch tool 18 at a shallower depth. This is as illustrated in FIG. 2B. The punch tool 18 is operated to provide a second set of perforations 128. Fluid is pumped through the throughbore 42, out of the ports 30 and allowed to enter the perforations 128. A return at surface is looked for. If this is obtained, as illustrated by the arrows in FIG. 2C, the cutting tool 20 is operated and a shorter upper length 48 of casing 12 is cut from a longer length of lower 50 casing 12 and pulled from the well bore 10. This is shown in FIGS. 2D to 2F and is achieved in an identical manner to that shown and described with reference to FIGS. 1D to 1F.

If the circulation test at FIG. 2A was also negative then the steps of perforating at a shallower depth and performing a circulation test would be repeated until a positive circulation test result is achieved. Only on noting a positive circulation test would the casing be cut and an attempt to pull would be made. This saves valuable time in cutting and pulling when the casing is likely to be stuck.

In the unlikely event of a positive circulation test, a cut being made and then the casing cannot be pulled, which may be due to uneven cement distribution in the annulus 46, the spear 22 can be released and the method steps repeated with perforations at a shallower depth which will hopefully be above the stuck point. This will still be achieved on a single trip in the well bore 10.

Thus the method of the present invention provides for a single trip casing cutting and pulling system in which the tool string is run to a maximum depth, testing is performed via perforations to see if a circulation path to surface exits which is used to indicate the likelihood of being able to pull the casing at the perforated depth. If circulation is not achieved, further perforations and testing are performed at progressively shallower depths until a positive circulation test is achieved and the casing is pulled. This is in direct contrast to the prior art systems which begin at a shallower depth and move to greater depths, washing, cutting and pulling casing sections at each step which means multiple steps into the well bore are required.

In the present invention once the casing section has been recovered, one could re-enter the lower length of casing and see if a circulation path to the cut can be found, now that a weight of material has been removed.

Further, as illustrated in FIG. 3 the method can include the step(s) of providing perforations at shallower depths in the well bore 10. In FIG. 3, like parts to those of FIGS. 1 and 2 have been given the same reference numeral to aid clarity. In FIG. 3 a wellhead seal assembly 54 is in place at surface 56. The assembly 54 blocks the annulus 46 and thus perforations 58 are provided near surface 56 to provide a path for returned fluids to test for circulation. By creating such perforations, the assembly 54 can remain in place until pulling of the cut length of casing 12 is required. For prior art systems the assembly 54 would need to be removed in order to perform the washing step. By keeping the assembly 54 in place, well control is maintained and less damage occurs at the wellhead. In the present invention, the wellhead seal assembly 54 can be removed on the same single trip as the casing recovery.

Perforations 58 advantageously allow the migration of gas from the annulus 46 between the casing 12 and the bore 14.

Further test perforations 60 can be made at different depths in the casing 12. The test perforations 60 are arranged to lie between the packer 26 and the perforations 28. In this way, a circulation test can be performed over a shorter length of casing between the two sets of perforations 28,60. This technique can be used to locate a fill level 62 of material 44 in the annulus 46.

The principle advantage of the present invention is that it provides a method of cutting and pulling the maximum possible length of casing in a single trip into a well bore.

A further advantage of the present invention is that it provides a method of cutting and pulling casing wherein the casing is cut and pulled only when an indication of the likelihood of being able to pull the casing is given.

It will be apparent to those skilled in the art that modifications may be made to the invention herein described without departing from the scope thereof. For example, the tool string may include a downhole pulling tool, such as the DHPT available from the present Applicants, or a jar to assist in pulling the cut casing from the well bore. Additionally, reference has been made to shallower and deeper, together with upper and lower positions in the well bore. It will be recognised that these are relative terms though a vertical well bore is illustrated the method and apparatus apply equally to deviated and horizontal well bores.

I claim:

1. A method of removing casing from a well, in which an annulus between the outside of the casing and the inside of a surrounding downhole body is at least partially filled by a viscous and/or solid mass, the method comprising:

(a) lowering a string into the well, a packer, a punch tool, and a cutting tool being connected to the string, and the string being arranged to carry a fluid;

(b) locating an end of the string in relation to a plug in the casing, the plug providing a seal across the bore of the casing at a first depth;

(c) forming one or more perforations through the casing with said punch tool at a second depth in the well, the second depth being shallower than the first depth;

(d) setting the packer at a third depth, the third depth being shallower than the second depth;

(e) pumping fluid through the string and through the one or more perforations;

(f) a circulation test is performed by looking for a return at surface which determines if fluid has managed to pass through material in the annulus between the outside of the casing and the surrounding downhole body;

(g) in the event that a return is detected at surface, cutting the casing using the cutting tool to separate a length of cut casing from plugged casing; and (h) pulling the length of cut casing from the well.

2. The method according to claim 1 wherein in the event that a return is not detected, the punch tool is moved to a fourth depth, shallower than the second depth and steps (c) to (f) are repeated.

3. The method according to claim 2 wherein steps (c) to (f) are repeated at increasingly shallower depths until a return is detected at surface and steps (g) and (h) are then completed.

4. The method according to claim 1 wherein all the steps are performed on a single trip in the well.

5. The method according to claim 1 wherein the method includes the step of circulating fluid through the cutting tool, the casing at the cut and up the annulus between the outside of the casing and the inside of the surrounding downhole body.

6. The method according to claim 1 wherein tension is applied to the string to expand the packer.

7. The method according to claim 1 wherein tension is applied to the string to operate the punch tool.

8. The method according to claim 1 wherein the packer is set and the punch tool is activated simultaneously.

9. The method according to claim 1 wherein the method includes the step of anchoring the string to the casing.

10. The method according to claim 1 wherein the method includes an initial step of creating one or more upper perforations using the punch tool towards an upper end of the casing to be cut.

11. The method according to claim 1 wherein the method includes the step of creating one or more test perforations using the punch tool, such test perforations being at a depth shallower than the third depth, and performing a circulation test by circulating fluid between the perforations and the test perforations to detect circulation at surface.

12. The method according to claim 1 wherein in step (g) the casing is cut by making a circumferential cut through the casing.

13. The method according to claim 1 wherein the string is a coiled tubing string.

14. The method according to claim 1 wherein the string is a drill string.

15. The method according to claim 1 wherein the method includes the step of setting the plug at the first depth to provide the seal across the bore of the casing.

16. A method of removing casing from a well, in which an annulus between the outside of the casing and the inside of a surrounding downhole body is at least partially filled by a viscous and/or solid mass, the method comprising:

(a) lowering a string into the well, a packer, a punch tool, and a cutting tool being connected to the string, and the string being arranged to carry a fluid;

(b) locating an end of the string in relation to a plug in the casing, the plug providing a seal across the bore of the casing at a first depth;

(c) forming one or more perforations through the casing with said punch tool at a second depth in the well, the second depth being shallower than the first depth;

(d) setting the packer at a third depth, the third depth being shallower than the second depth;

(e) pumping fluid through the string and through the one or more perforations;

(f) looking for a return at surface;

(g) in the event that a return is detected at surface, cutting the casing using the cutting tool to separate a length of cut casing from plugged casing, including circulating fluid through the cutting tool, the casing at the cut and up the annulus between the outside of the casing and the inside of the surrounding downhole body; and (h) pulling the length of cut casing from the well.

* * * * *